United States Patent [19]

Komatsu

[11] 4,191,502

[45] Mar. 4, 1980

[54] CARGO-HANDLING MACHINE WITH 300-DEGREE OPERATIONAL AZIMUTH RANGE FOR SHIPBOARD USE

[75] Inventor: Tadaomi Komatsu, Akashi, Japan

[73] Assignee: Kawasaki Jukogyo Kabushiki Kaisha, Kobe, Japan

[21] Appl. No.: 935,865

[22] Filed: Aug. 22, 1978

[51] Int. Cl.[2] ..... B63B 27/04

[52] U.S. Cl. ..... 414/140; 212/3 A; 212/58 A; 212/70; 414/139

[58] Field of Search ..... 212/3 R, 70, 58 A, 3 A, 212/8 R, 9, 35 R, 57, 58 R, 66; 414/140, 139, 138, 137

[56] References Cited

U.S. PATENT DOCUMENTS

| | | | |
|---|---|---|---|
| 3,384,246 | 5/1968 | Cochran | 212/3 |
| 3,386,593 | 6/1968 | Spreng | 212/3 |

*Primary Examiner*—Stephen G. Kunin
*Assistant Examiner*—George F. Abraham
*Attorney, Agent, or Firm*—Haseltine, Lake & Waters

[57] ABSTRACT

A double-topping type derrick crane is operable continuously throughout 300 degrees of azimuth turning of its boom to serve two loading areas forward and aft of the crane. This is made possible by a multiple-swivel, universal coupling mechanism between the two topping tackles and the boom top, this mechanism permitting one topping tackle to flip over the other, whereby the relative positions of the tackles are automatically inverted without mutual contacting or entwinement of the topping tackles.

8 Claims, 22 Drawing Figures

FIG. 3
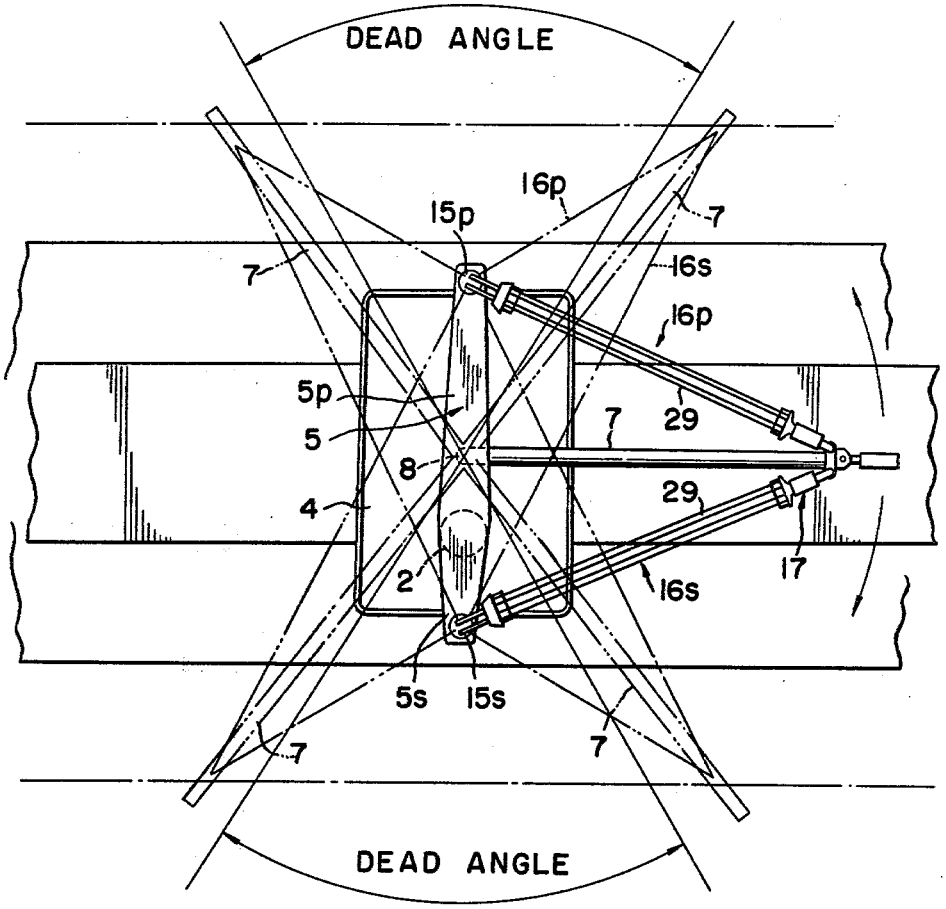
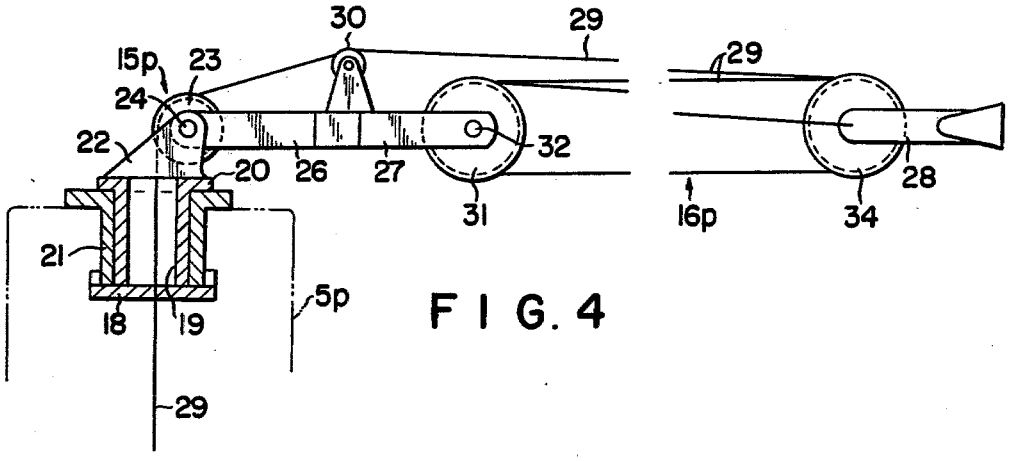
FIG. 4

CARGO-HANDLING MACHINE WITH 300-DEGREE OPERATIONAL AZIMUTH RANGE FOR SHIPBOARD USE

BACKGROUND OF THE INVENTION

This invention relates generally to cargo-handling apparatuses and systems for shipboard or marine use and more particularly to derrick cranes of the so-called double-topping type for shipboard use.

Ever since cargo handling by means of a double-topping derrick crane was developed as disclosed in the specification of Japanese Pat. No. 91,483, issued May 20, 1931, various improvements and developments relating to this type of cargo-handling machine have been made in several countries. This type of machines, which have thus been developed from light-lift derrick machines to heavy-lift machines of the type which can be operated doubly for fore and aft hatches, are still being widely used as efficient cargo-handling machines for shipboard use.

This invention relates to a cargo-handling machine of the above mentioned double-topping type doubly operable for fore and aft hatches which has a derrick boom which can be swung around a ship side and operated over a continuous range of azimuth angle of 300 degrees without the necessity of dismantling the boom topping tackle.

In spite of the above mentioned development of cargo-handling machines ot the double-topping type, the booms of their derrick cranes are limited in the range of azimuth angle in which they can operate, as described hereinafter. This limited working range is of the order of 60 degrees on each side of the ship centerline or a total of 120 degrees on each of the forward and after sides of the derrick post. That is, there are so-called "dead angle" zones each of the order of 40 to 60 degrees at the two sides of the ship into which a conventional derrick boom cannot be swung. In a conventional double-topping derrick crane, furthermore, the boom cannot be swung through the so-called dead angle from either of the forward and after sides of the derrick post to the other, that is, around the ship side.

Because of these limitations in the operational azimuth range of the booms of conventional machines of the instant character, difficulties arise in loading large and long cargo units as described hereinafter. These difficulties give rise to problems in view of the recent trend toward the shipment of cargo units of ever increasing size, particularly length.

SUMMARY OF THE INVENTION

It is an object of this invention to provide a cargo-handling machine of double-topping derrick type for shipboard use which is doubly operable for hatches on the forward and after sides thereof, and which has a derrick boom adapted to be swung around a ship side and safely operated throughout a continuous range of azimuth angle of approximately 300 degrees without the necessity of dismantling the boom topping tackle.

Another object of the invention is to provide a cargo-handling machine of the above stated nature having a multiple-swivel, universal coupling mechanism between the top or outer end of the derrick boom and the outer-end blocks of the two topping tackles, which coupling enables these tackle blocks to revolve about an axis of symmetry therebetween thereby to be flipped over into mutually inverted position when the boom moves from one of the fore and aft loading areas with respect to the machine to the other, and which coupling enables prevention of a great moment being imposed on the derrick boom even when there is a great unbalance of the stress loads on the two topping tackles.

Still another object of the invention is to provide the above stated cargo-handling machine in combination with auxiliary derrick or deck cranes, whereby the operation of the main derrick crane can be safely carried out throughout the 300-degree operational range without risk of the so-called runaway boom phenomenon, wherein the boom, being unstably supported by only one of the topping tackles, swings unstably and uncontrollably.

A further object of the invention is to provide a cargo-handling machine of the above stated character which is capable of loading and unloading a large number of long bulky cargo units on and off on-deck loading areas of the ship forward of and abaft the machine.

According to this invention, briefly summarized, there is provided a cargo-handling machine for shipboard use comprising essentially a derrick crane of the double-topping type having an outrigger fixed to the top of a derrick post, which is fixed to a ship at a position between two loading areas forward and aft of the post, a derrick boom pivotally supported at its inner end by a gooseneck connection permitting azimuthal turning of the boom through at least 150 degrees on each of the forward and after sides of the post and permitting topping movement of the boom, and two boom topping tackles swivel-connected at their inner ends to respective outer end of the outrigger, a unique feature of the machine being a multiple-swivel universal coupling connected between the boom top and the outer ends of the two topping tackles and functioning to permit the two topping tackles to undergo inversion of their positions relative to the boom without mutual contact or entwinement when the boom turns through a dead-abeam position relative to the outrigger in moving from one loading area to the other.

The nature, utility, and further features of this invention should be apparent from the following detailed description with respect to preferred embodiments of the invention when read in conjunction with the accompanying drawings, which are briefly described below, and throughout which like parts are designated by like reference numerals and characters.

BRIEF DESCRIPTION OF THE DRAWINGS

In the drawings:

FIG. 3 is a plan view of the same derrick crane;

FIG. 4 is a relatively enlarged side elevation showing parts of the topping tackle and the swivel pulley of the derrick crane of this invention;

DETAILED DESCRIPTION

Figure 2:
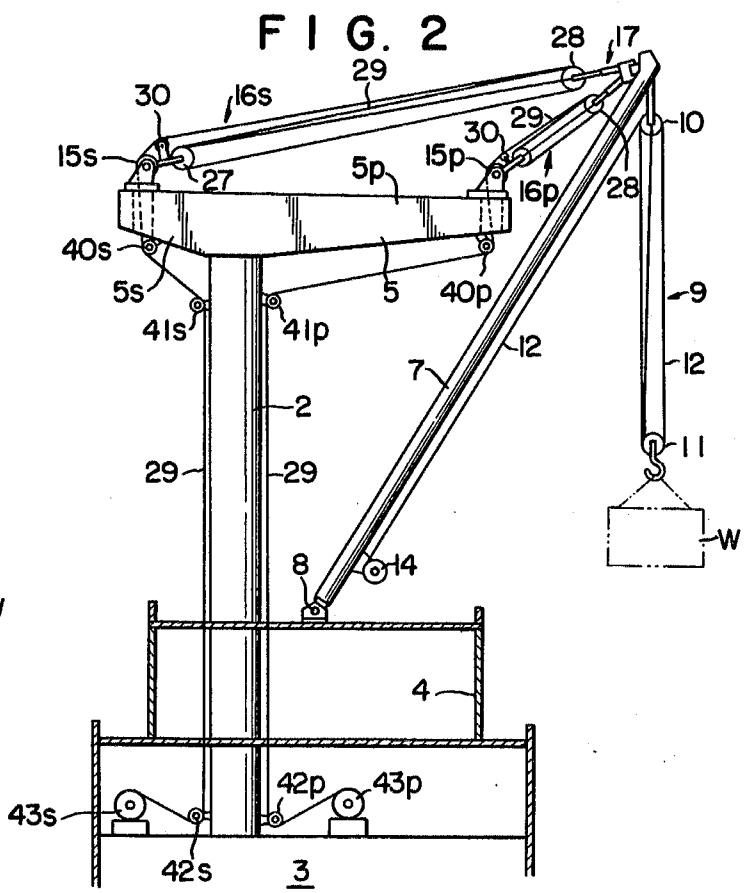
FIG. 2 is an elevation as viewed in the aft-to-fore direction of the same derrick crane.
Figure 1:
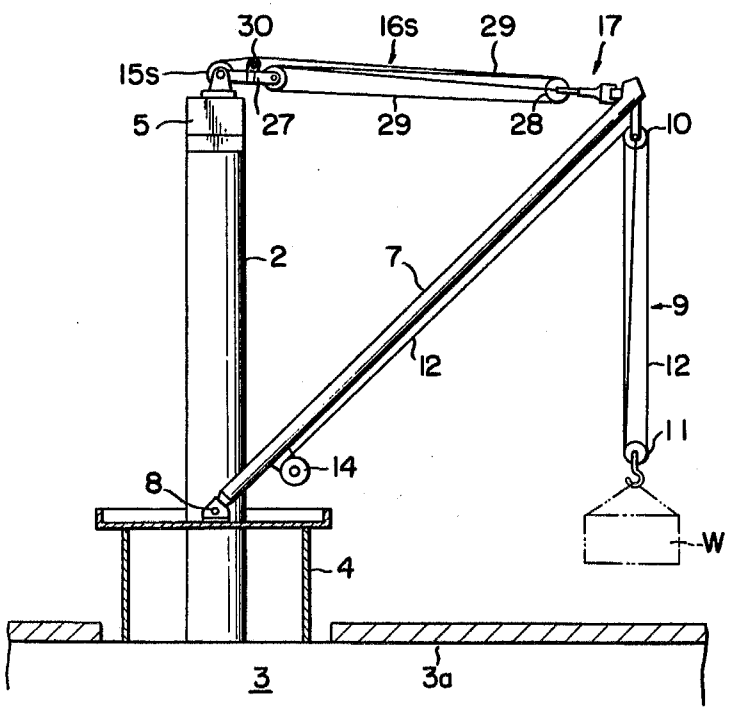
FIG. 1 is a side elevation showing the essential construction of one example of a double-topping derrick crane according to this invention.

Rererring to FIGS. 1, 2 and 3, a first example of the cargo-handling machine illustrated therein is of double-topping derrick type which is doubly operable for hatches of a ship on the forward and after sides of the derrick.

The cargo-handling machine comprises a derrick post 2 fixedly mounted in upright state on a base 3 provided in the hull 3*a* of the ship. A support structure 4 rigidly mounted on the base 3 also serves to support the post 2. An outrigger 5 is fixedly supported on the top of the post 2 and made up of port and starboard arms 5*p* and 5*s* extending transversely to the fore-and-aft direction of the ship. As will be seen from FIGS. 2 and 3, the post 2 is disposed at a position offset from the ship center-line toward the starboard side, and the port arm 5*p* of the outrigger is longer than the starboard arm 5*s*.

A derrick boom 7 is pivotally supported at its lower gooseneck end by a gooseneck fitting 8 fixed on the support structure 4, so that the boom can be topped up and down and also turned horizontally. A cargo-hoisting tackle 9 is suspended from the top of the boom 7 and comprises a pair of tackle blocks 10 and 11 and a wire cable 12 passed around these blocks. The fall of the cable 12 is led down from the upper tackle block 10 and wound around a cargo-hoisting winch 14 supported by the boom 7 and driven by motive power means such as an electric motor also supported by the boom 7.

A swivel pulley 15*p* is provided on the free end of the outrigger port arm 5*p*, and an identical swivel pulley 15*s* is provided on the free end of the outrigger starboard arm 5*s*. The swivel pulley 15*p* is connected to the top of the boom 7 by way of a topping tackle 16*p* and a multiple-swivel, universal-coupling mechanism generally designated by reference numeral 17. Similarly, the swivel pulley 15*s* is connected to the top of the boom 7 by way of a topping tackle 16*s* and the universal coupling mechanism 17.

Figure 5:
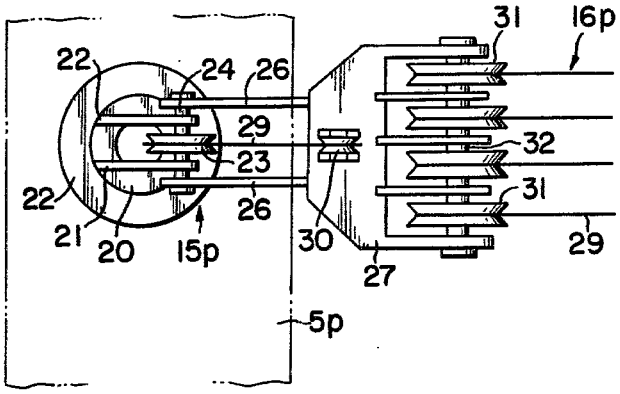
FIG. 5 is a corresponding plan view of a part of the topping tackle and the swivel pulley shown in FIG. 4.

The swivel pulleys 15*p* and 15*s* have identical construction, so that details of only the port swivel pulley 15*p* will be described below with reference to FIGS. 4 and 5. As illustrated therein, the swivel pulley 15*p* has a swivel sleeve 19 with a horizontal flange 20, which sleeve 19 is rotatably fitted in a bearing member 21 fixed in the outer end of the port outrigger arm 5*p*. A bottom flange 18 is provided on the sleeve 19 to prevent upward displacement of the sleeve. A fork type bracket 22 is integrally formed on the flange 20, and a lead sheave 23 is rotatably supported by a pin 24 passed through the bracket 22. The pin 24 supports the outer ends of arms 26 projecting from one tackle block 27 of the aforementioned topping tackle 16*p*.

The topping tackles 16*p* and 16*s* have identical construction, so that only the tackle 16*p* will be described below. The tackle 16*p* further comprises another tackle block 28 and a wire cable 29. The tackle block 27 has a lead sheave 30 rotatably supported thereon, and four sheaves 31 rotatably mounted on a common pin 32.

Figure 6:
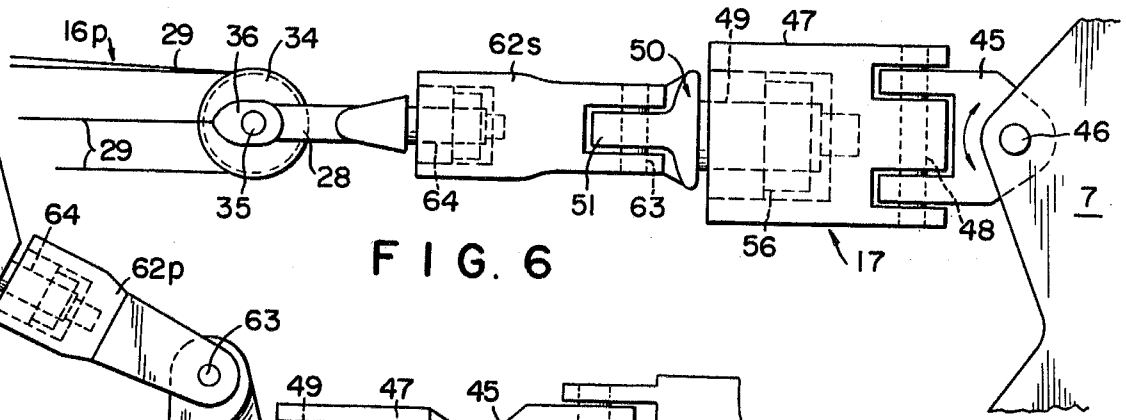
FIGS. 6 and 7 are respectively a relatively enlarged elevation and a corresponding plan view showing an example of a multiple-swivel, universal coupling mechanism for connecting the topping tackles to the top of the boom of the derrick crane of the invention, this coupling mechanism constituting an essential component of this invention.
Figure 7:
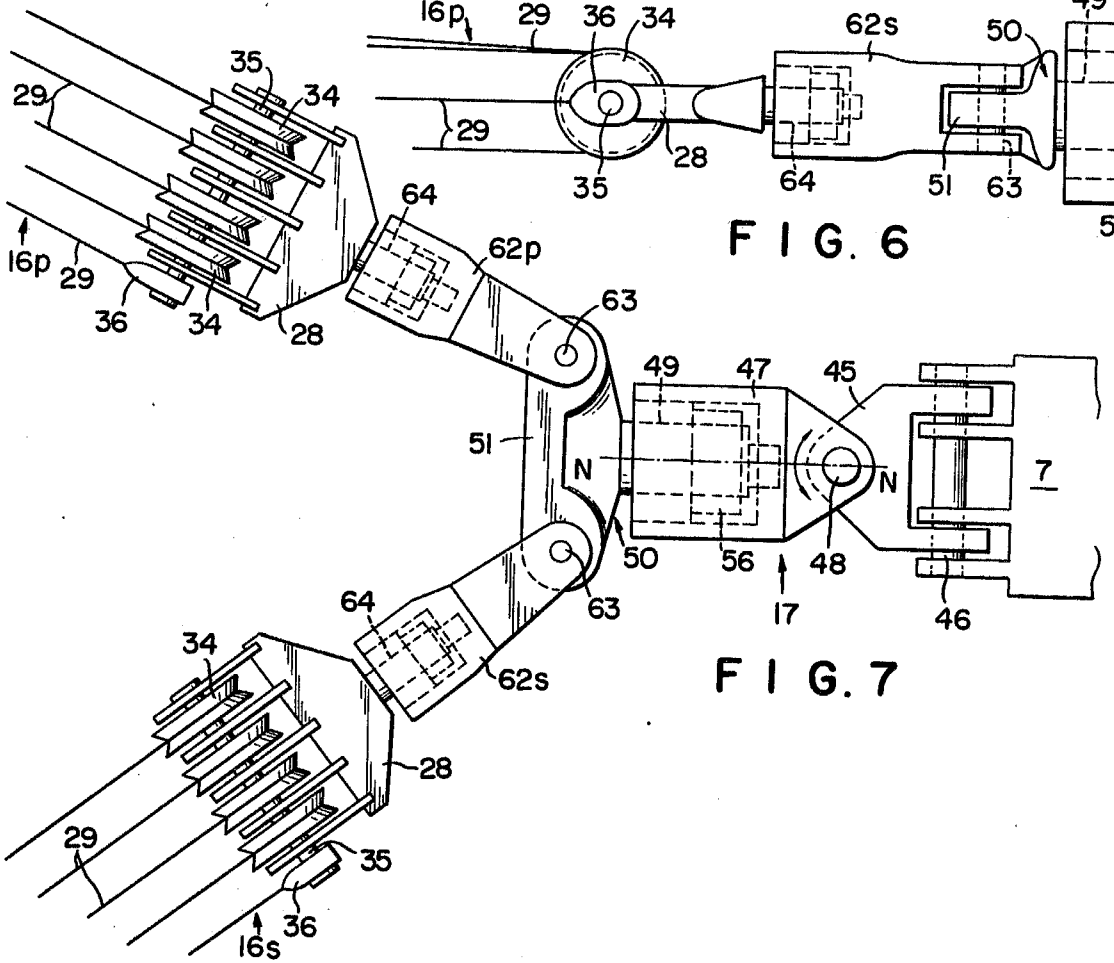

Details of the tackle block 28 of the topping tackle 16*p* are shown in FIGS. 6 and 7. The tackle block 28 is of a construction similar to the tackle block 27 and comprises four sheaves 34 rotatably supported on a common pin 35 as shown. An anchoring member 36 for securing one end of the cable 29 is fitted on the pin 35.

The cable 29 extending from the anchoring member 36 is passed around the sheaves 31 and 34 in turn and led out from the last sheave 34 to be passed over the aforementioned lead sheaves 30 and 23, as indicated in FIG. 4. The cable 29 then extends down through the hollow interior of the sleeve 19 of the swivel pulley 15*p* and, as shown in FIG. 2, is passed over a lead sheave 40*p* supported on the lower side of the port outrigger arm 5*p*, a lead sheave 41*p* supported on the post 2, and a lead sheave 42*p* supported within the support structure 4, to be wound around a winch 43*p* for topping. Similarly, the topping cable 29 led out from the starboard topping tackle 16*s* is passed over lead sheaves 40*s*, 41*s* and 42*s* and wound around a winch 43*s* for topping.

Referring again to FIGS. 6 and 7, one example of the aforementioned universal coupling mechanism 17, which couples the blocks 28, 28 of the port and starboard topping tackles 16*p* and 16*s* with the top of the boom 7, is illustrated in detail therein. This universal coupling mechanism 17 has a pivotable member 45 pivotally connected at one end thereof to the top of the boom 7 by means of a horizontal coupling pin 46. The other end of the pivotable member 45 is joined to one end of a swivel socket member 47 by means of a vertical coupling pin 48. Within the swivel socket member 47 is rotatably received a stem part 49 of a headed-stem member 50 having a yoke 51, so that the headed-stem member 50 is turnable relative to the swivel socket member 47 around the longitudinal axis N-N thereof.

Figure 8:
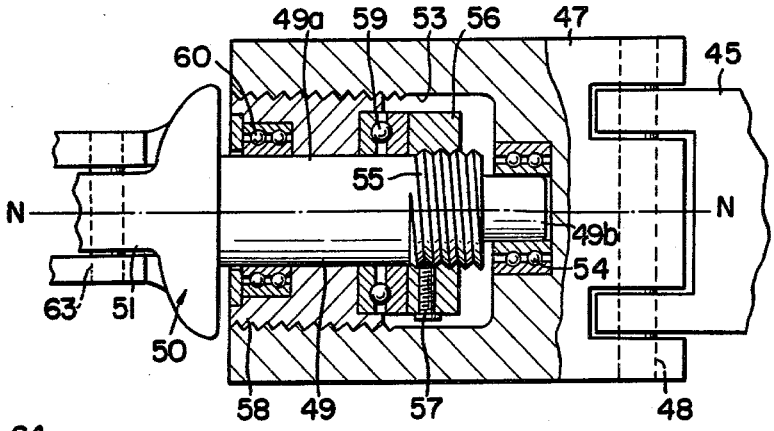
FIG. 8 is a further enlarged side view, with parts shown in longitudinal section, showing one example of the internal construction of a swivel in the universal coupling illustrated in FIGS. 6 and 7.

As illustrated in detail in FIG. 8, the swivel socket member 47 has an internally threaded bore 53, and in the innermost end of the bore 53 there is formed a reduced diameter hole in which a bearing 54 is fitted. The stem part 49 of the headed-stem member 50 is made up of a cylinderical main portion 49*a* having a threaded part 55, and a cylindrical reduced diameter portion 49*b* which is rotatably supported in the bearing 54. A nut 56 constituting the head of the headed-stem member 50 is screwed on the threaded part 55 and locked by a set screw 57. An externally threaded annular member 58 is screwed in the threaded bore 53 in such a manner that a thrust bearing 59 is interposed between the nut 56 and the annular member 58, whereby the stem part 49 is held immovably in its axial direction from within the swivel socket member 47. A bearing 60 is provided in the annular member 58 to support the stem part 49.

As shown in FIG. 7, the headed-stem member 50 is integrally formed at its outer end with the yoke 51 extending transversely to the direction of the axis N-N, and to one end of this yoke 51 is pivotally joined one end of a swivel socket member 62*p* by means of a coupling pin 63. The swivel socket member 62*p* is of a construction substantially identical to that of the aforementioned swivel socket member 47 and rotatably receives and holds therein a cylindrical headed stem 64 extending from the tackle block 28 of the port topping tackle 16*p*. A revolvable swivel socket member 62*s*, identical to the swivel socket member 62*p*, is similarly joined to the other end of the yoke 51 and rotatably receives and holds therein a cylindrical headed stem 64 extending from the tackle block 28 of the starboard topping tackle 16*s*.

Thus, it will be seen that the multiple-swivel, universal coupling mechanism comprises: the swivels 62*s* and 62*p* of the two topping tackle blocks 28, 28, which are thereby swivel blocks; a common swivel comprising essentially the swivel socket member 47 and the headed-stem member 50 with a yoke 51 to the ends of which the swivels 62*s* and 6*sp* are pivotally connected by vertical pins 63, 63; and a universal joint comprising the swivel socket member 47, the pivotal member 45, the vertical pin 48 pivotally connecting these members 47 and 45, and a horizontal pin 46 pivotally connecting the pivotal member 45 and the top of the boom 7.

This universal coupling mechanism 17 functions to permit the unique operation of the derrick boom 7 throughout a working azimuth range of 300 degrees without excessive forces acting on any part and to permit the flipping of one topping tackle over the other when the boom is swung past a swing (azimuth) angle of 90 degrees from its original position coinciding with the ship centerline, whereby the positions of the two topping tackles relative to the boom top as viewed in plan view are automatically inverted without mutual contacting or entwinement of the two tackles.

Figure 9A:
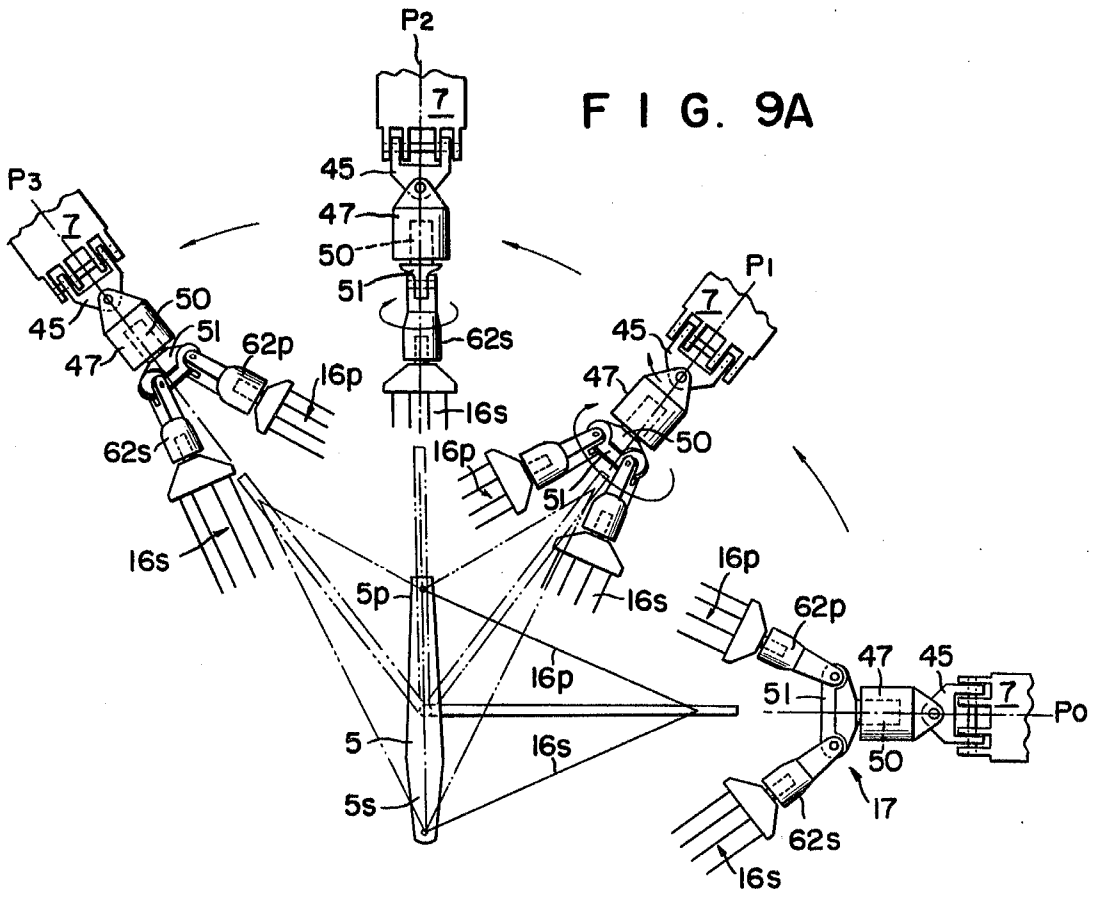
FIG. 9A is a diagrammatic plan view indicating the states of the same universal coupling and the topping tackles for different angular positions of the derrick boom.
Figure 9B:
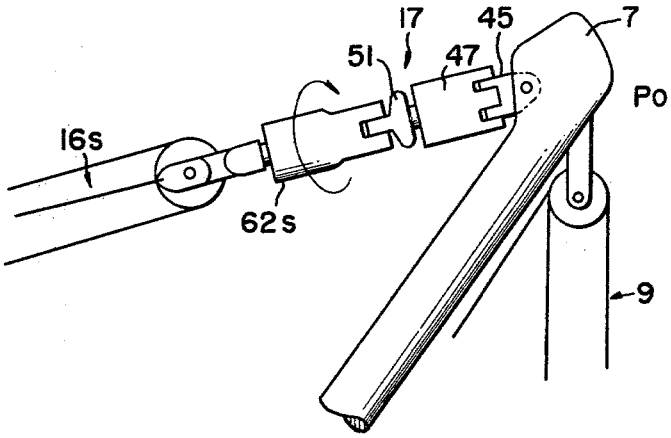
FIGS. 9B and 9C are elevational views corresponding to boom positions $P_0$ and $P_2$ in FIG. 9A.
Figure 9C:
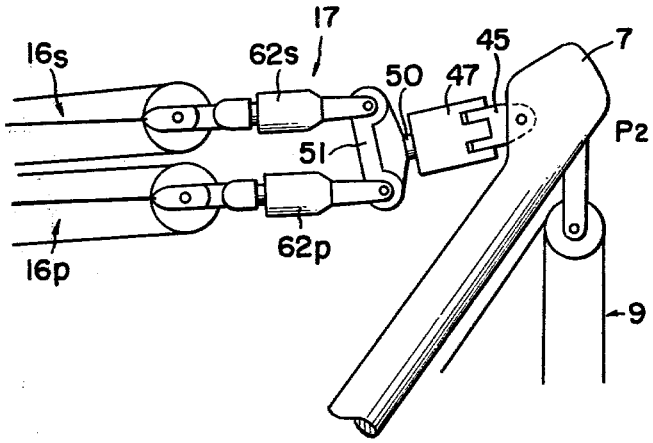

This inversion of the positions of the topping tackles is indicated in FIGS. 9A, 9B, and 9C. In FIG. 9A, the boom is indicated as being swung from an original position $P_0$, through an approximately 45-degree swing angle position $P_1$, a 90-degree swing angle position $P_2$, and an approximately 135-degree swing angle position $P_3$. The elevational views of FIGS. 9B and 9C correspond respectively to the positions $P_0$ and $P_2$ in FIG. 9A. At its position $P_0$, the boom 7 is forward of the derrick post and out-rigger 5.

As the boom 7 is swung counterclockwise toward the port beam, the headed-stem member 50, integral with the yoke 51, of the universal coupling mechanism 17, rotates within the swivel socket member 47 in the counterclockwise direction relative thereto as viewed from the topping tackles outward toward the boom top. Consequently, the starboard topping tackle 16*s* progressively assumes a higher position relative to the port topping tackle 16*p* until it reaches its highest position at the position $P_2$ of the boom. Then, as the boom 7 swings further past the 90-degree position $P_2$, the headed-stem member 50 and the yoke 51 rotate further in the counterclockwise direction, whereby the positions of the topping tackles 16*s* and 16*p* are inverted as shown in FIG. 9A.

Figure 10:
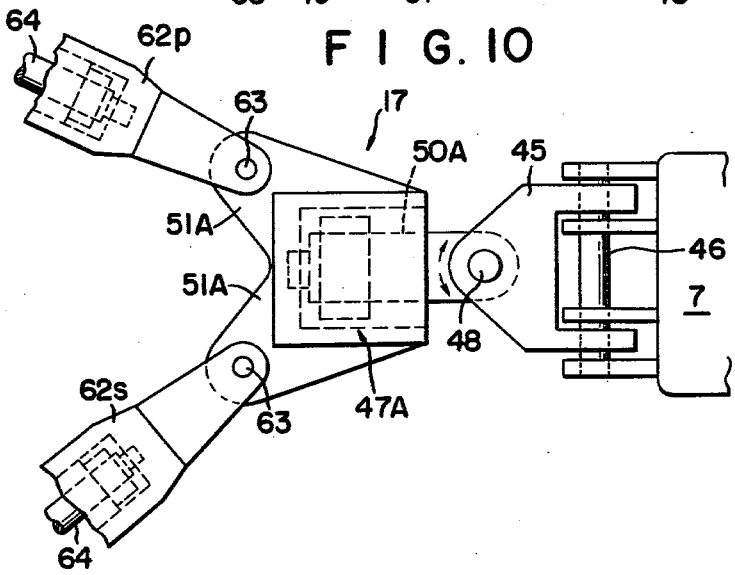
FIG. 10 is a relatively enlarged plan view showing another example of the multiple-swivel, universal coupling according to this invention.

In a modification of the universal coupling mechanism 17 as illustrated in FIG. 10, the universal joint parts comprising the pins 46 and 48 and the pivotal member 45 and the swivels 62*s* and 62*p* of the two swivel blocks 28, 28 are the same as those in the mechanism shown in FIGS. 6 and 7, but the components of the common swivel connecting the swivel blocks 28, 28 to the universal joint are reversed. That is, this swivel comprises essentially a headed-stem member 50A pivotally connected at its outer end to the pivotal member 45 by the vertical pin 48 and a swivel socket member 47A rotatably receiving and holding the headed end of the headed-stem member 50A and provided with yoke members 51A, 51A integrally formed therewith. The outer swivel blocks 28 of the topping tackle are pivotally connected to the yoke members 51A and 51A by the vertical pins 63, 63.

In the example of a double-topping type derrick crane as described hereinbefore with reference to and as illustrated by FIGS. 1, 2, and 3, the inner end of the boom 7 is pivotally supported by a gooseneck connection 8 in the form of a universal joint permitting topping movement of the boom and also swinging horizontally. The gooseneck connection 8 is mounted on the support structure 4 rigidly fixed to the ship hull 3*a*. In order to permit the boom 7 to swing horizontally through the 300-degree range described hereinbefore, the derrick post 2 is offset from the ship centerline toward the starboard side. This invention is not limited to a derrick crane of this construction but is applicable to a number of other derrick cranes of the double-topping type which can be doubly operated for fore and aft hatches.

Figure 11A:
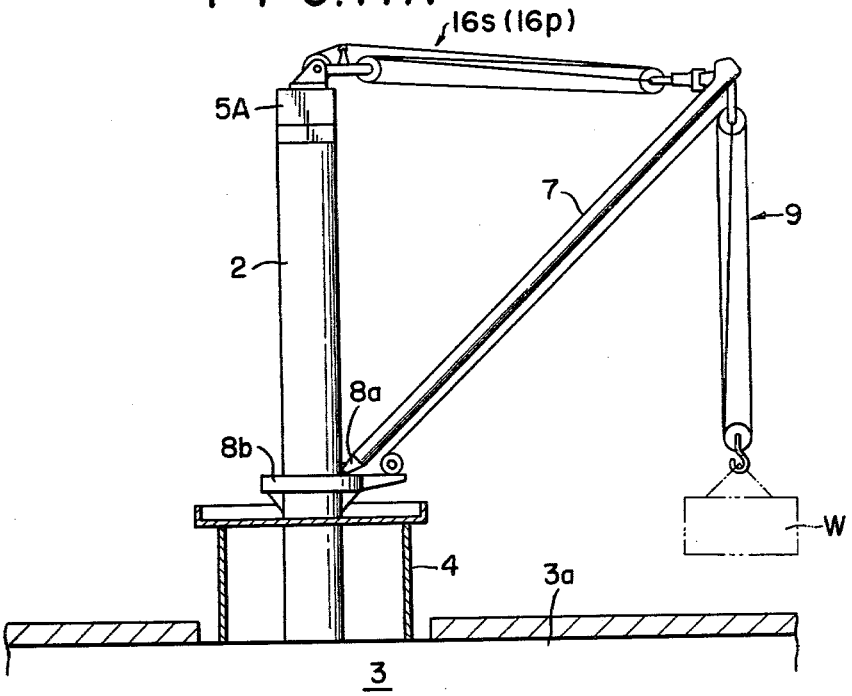
FIGS. 11A and 11B are respectively a side elevation and a corresponding plan view showing the essential construction of another example of a double-topping type derrick crane to which this invention can be applied.
Figure 11B:
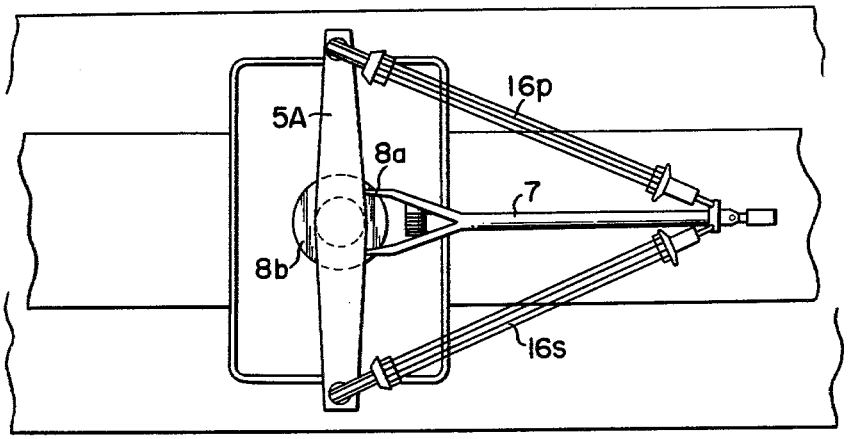

For example, the invention can be applied to a derrick crane as illustrated in FIGS. 11A and 11B. In this crane, the boom 7 is pivotally supported at its inner forked end by a gooseneck connection 8*a* mounted on a turnable gooseneck ring 8*b* and permitting topping movement of the boom. The inner forked end of the boom 7 and its gooseneck connection 8*a* can thus ride on the gooseneck ring 8*b* in revolving movement around the base of the derrick post 2, which can be positioned on the ship centerline. The out-rigger 5A in this case is of symmetrical construction, having starboard and port arms of equal length. The winch 14 for cargo hoisting can be conveniently mounted on the gooseneck ring 8*b*. A feature of this derrick crane is that cargo loading or unloading can be carried out on either of the starboard and port sides. The other parts and features of this derrick crane are similar to those of the crane shown in FIGS. 1, 2, and 3.

Figure 12A:
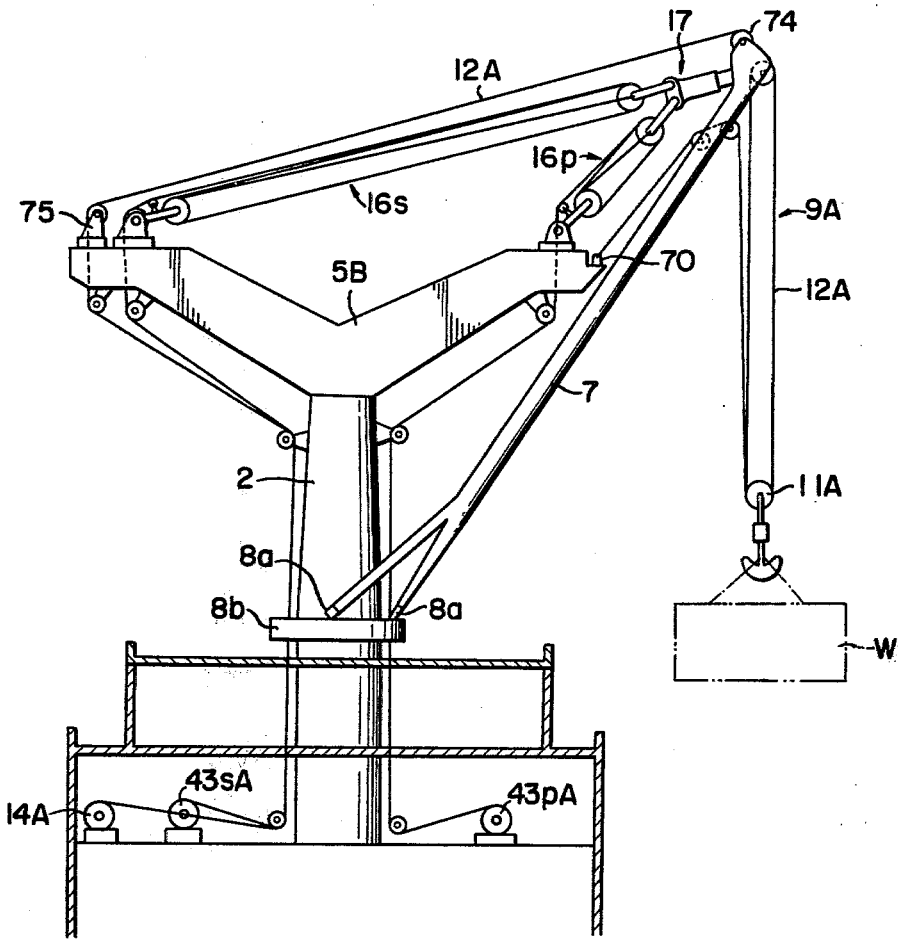
FIG. 12A is an elevation as viewed in the aft-to-fore direction showing still another form of a double-topping type derrick crane to which this invention can be applied.
Figure 12B:
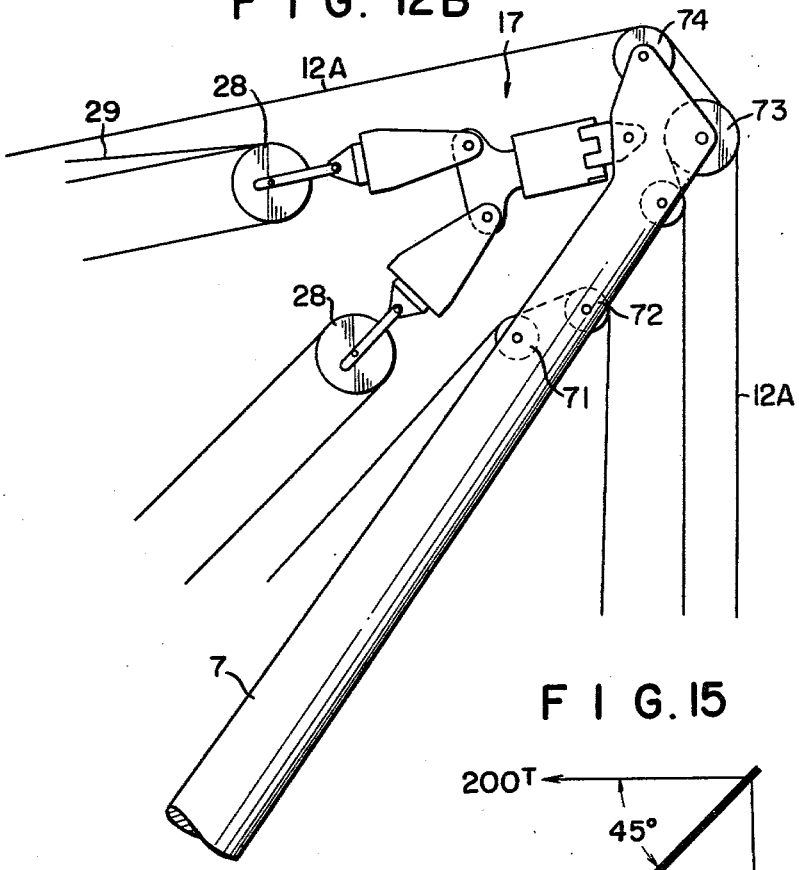
FIG. 12B is a relatively enlarged elevation showing the top of the boom and related parts in the derrick crane illustrated in FIG. 12A.

Still another example of a derrick crane to which this invention can be applied is illustrated in FIGS. 12A and 12B. This crane is designed for heavy cargo loads, and, since its cargo hoisting winch 14A becomes large and heavy, it cannot be easily mounted on the gooseneck ring. Accordingly, this winch 14A is mounted on the ship hull at a low position such as the base structure on which the boom topping winches 43*s*A and 43*p*A are mounted. Another difference is the design of the cargo hoisting tackle 9A. One end of the tackle cable is anchored at a point 70 on the extreme outer end of one arm of the outrigger 5B. Instead of a tackle block suspended from the top of the boom 7, sheaves such as 71, 72, 73, and 74 are used, and the tackle cable 12A is passed around these sheaves and then to a swivel pulley 75 at the extreme outer end of the outer arm of the outrigger 5B. From the swivel pulley 75, the fall part of the cable 12A is led down by lead sheaves to the hoisting winch 14A.

The operation of the cargo-handling machine will now be described.

For the purpose of adjusting the topping angle (vertical angle) of the derrick boom 7 for topping operation, the two topping winches 43*p* and 43*s* are driven simultaneously in the cable winding or unwinding direction, so that the wire cables 29 are taken up or paid out to shorten or lengthen the port and starboard topping tackles 16*p* and 16*s*, thereby to raise or lower the boom 7, respectively.

For the purpose of turning the derrick boom 7 around its gooseneck fitting 8, one of the winches 43*p* and 43*s* is driven in one direction and the other is driven in the opposite direction. For example, when the winch 43*p* is driven in its winding direction and the other winch 43*s* in its unwinding direction, the port topping tackle 16*p* is shortened and the starboard topping tackle 16*s* lengthened, so that the boom 7 turns in a counterclockwise direction as viewed in FIG. 3.

In order to raise or lower a cargo W suspended from the tackle block 11, the cargo-hoisting winch 14 is driven in its winding or unwinding direction, so that the cargo-hoisting tackle 9 is shortened or lengthened, respectively.

As mentioned hereinbefore, there is a recent trend toward the shipment of large and long units of cargo, whereby there has been a corresponding demand for cargo-handling machines for handling these cargo units.

Figure 13:
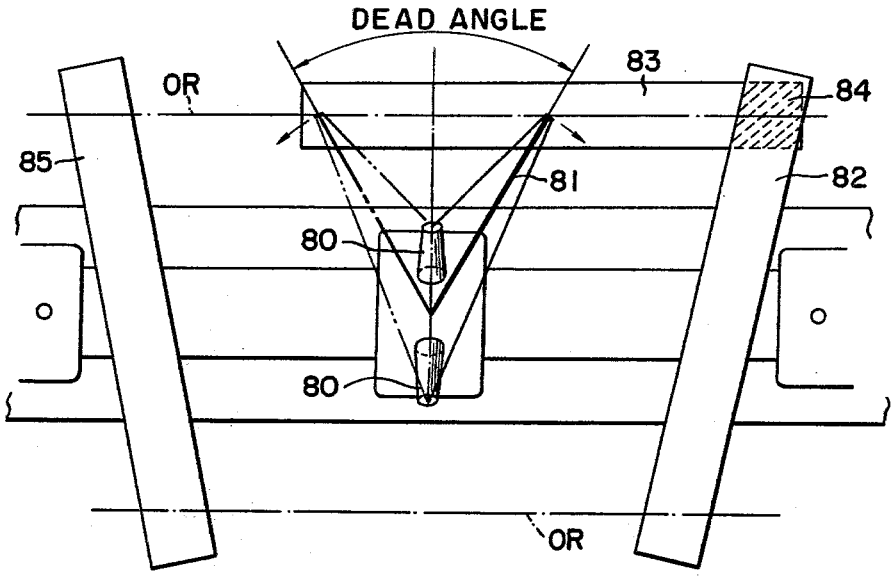
FIG. 13 is a diagrammatic plan view indicating the state of loading of long cargo units by means of a conventional double-topping type derrick crane.

One example of on-deck loading of long cargo units with a known cargo-handling machine is illustrated in FIG. 13. This machine has twin derrick posts 80, 80 and a center boom 81 which can be used through approximately 130 degrees of turn of the boom 81 on each of the forward and aftersides of the twin posts. When a first cargo unit 82 has been loaded, its overhanging end on the loading side obstructs the hoisting of a second cargo unit 83 as indicated by the hatched part 84. Consequently, the second cargo unit 83 must be loaded on the opposite side of the twin posts 80, 80 as at 85, whereby a total number of only two long cargo units can be loaded.

Figure 14:
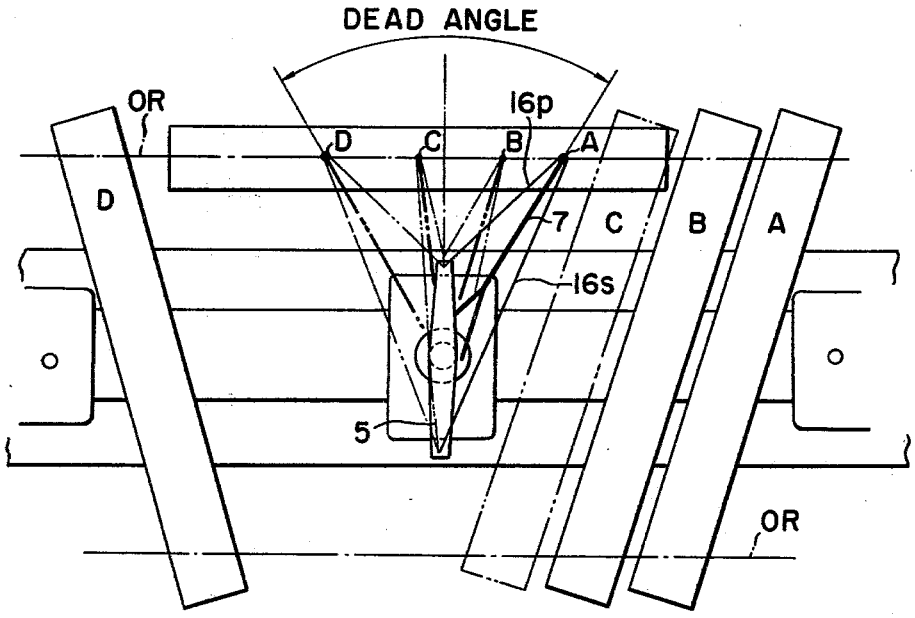
FIG. 14 is a similar diagrammatic plan view indicating the state of loading of long cargo units by means of a double-topping derrick crane according to the invention.

A corresponding example of similar on-deck loading of long cargo units under substantially the same conditions with the cargo-handling machine of this invention is shown in FIG. 14. Since the boom 7 in this machine can be used throughout the "dead angle" on the loading side, a total of four long cargo units can be loaded by shifting their hoisting points as at A, B, C, and D and loading these units in the order as at A, B, C, and D, respectively. Furthermore, while the maximum length of long cargo units which could be loaded by known cargo-handling machines of this character has been limited to approximately 40 meters, the cargo-handling machine of this invention is capable of loading long cargo units of lengths up to approximately 70 meters under the same conditions.

The operation of cargo-handling machines of the double-topping derrick type in general and according to this invention will now be described in greater detail. As stated hereinbefore, in a machine of this type, the stress load (tension) in the boom topping tackles is distributed in proportion to the lengths of the topping tackles 16*s* and 16*p* under the conditions of zero heel and zero trim. In an actual case, however, the ship heels because of the hoisted cargo and ordinarily has a trim angle of the order of 1 degree, whereby the difference between the stress loads imparted to the two topping tackles because even greater. This will be illustrated below with respect to a specific example.

Referring again to FIG. 3, as the outer end of the boom 7 is turned counterclockwise, the ship is caused to heel by the weight of the hoisted cargo. In the design of a ship for heavy cargo, in general, a heel of 10 degrees for loading is a condition, and all parts of the cargo-handling gear are designed on this basis. As the boom is turned counterclockwise as stated above, the span of the starboard topping tackle 16*s* becomes long and that of the port topping tackle 16*s* becomes short in accordance with the turning of the boom. The trim angle of approximately 1 degree has the effect of contributing to a dangerously unstable state of the derrick mechanism. When the boom swing-out angle (i.e., azimuth angle from the ship hull centerline) becomes approximately 60 degrees, the ratio between the stress loads in the topping tackles 16*s* and 16*p* becomes approximately 9:1. If the boom swing-out angle is increased further and the ship happens to roll or pitch because of waves from a ship or boat passing nearby, the topping tackle 16*p* will rapidly assume a no-load state, and the so-called runaway boom or jibbing boom phenomenon wherein the boom swings uncontrollably will occur, whereby there is a great possibility of a serious accident. For this reason, the limiting swing-out angle is normally set at about 60 degrees.

Figure 15:
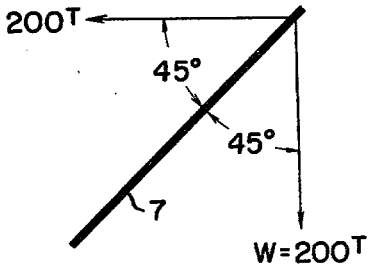
FIG. 15 is a diagram indicating forces acting on a derrick boom whose topping angle is 45 degrees.
Figure 16:
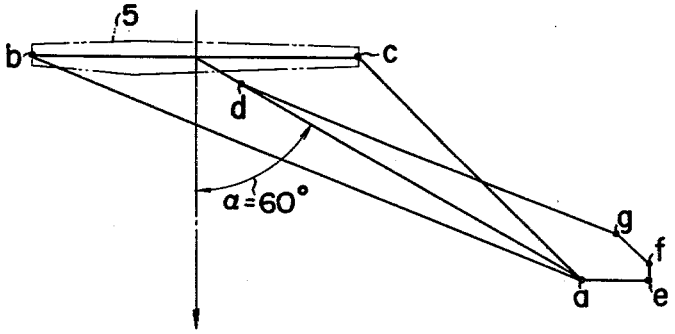
FIG. 16 is a vector diagram in an analysis of forces acting on the derrick boom as a result of certain conditions including heel and trim of the ship.

For simplification of the following analysis, it will be assumed that the boom topping angle (i.e., vertical angle above the horizontal) is 45 degrees as indicated in FIG. 15, and that the outer end a of the boom 7 and the points b and c of mounting of the swivel pulleys on the ends of the outrigger 5 on the derrick post as shown in FIG. 16 are all disposed at the same height. Furthermore, the own weights of parts such as the boom and the blocks and sheaves will be neglected. In the case where the cargo weight W is 200 tons (metric) in FIG. 15, the horizontal force resisting this cargo weight will also be 200 tons. The angles of heel and trim will be taken at their generally considered values of 10 degrees and 1 degree, respectively. Then, the increased force due to the heel angle will be W sin 10°=35 tons, and that due to the trim angle will be W sin 1°=3.5 tons.

In FIG. 16, the above mentioned horizontal force of 200 tons is represented vectorially by a d, the 35-ton force due to heel by a e, and the 3.5-ton force due to trim by e f. Then, when a first straight line is drawn parallel to a c from the point f and a second straight line is drawn parallel to a b from the point d to intersect the first straight line at a point g, the vector f g represents the stress load on the topping tackle at the point c under the above stated conditions, and the value of this stress load is measured as being 22 tons from this vector diagram. Furthermore, the vector g d represents the stress load on the topping tackle at the point b, and its value is measured as being 206 tons from the vector diagram. Thus, under the above stated conditions, the ratio between the stress loads action on the two topping tackles is 9.3:1. At a position symmetrical to FIG. 16 in the clockwise direction, the ratio becomes reversed, i.e., 1:9.3. Accordingly, the strengths of all parts such as the topping cable, blocks, and sheaves must be designed to resist these maximum stress load conditions.

The vertical pin 48 according to this invention as illustrated in FIGS. 6, 7, and 10 performs the important function of minimizing the moment acting on the boom by allowing the swivel socket member 47 to turn around the pin 48, thus relieving the combined stress loads tending to act on the boom, even with respect to the great unbalance of the stress loads on the two topping tackles.

Returning to the general case, since the stress load f g on the topping tackle at the point c is 22 tons under the above stated conditions, the runaway boom phenomenon does not occur. However, if the swing-out angle is increased further, the load f g gradually becomes smaller and becomes zero at a swing-out angle in the vicinity of 77 degrees. However, when a fore-and-aft oscillation of the cargo occurs at a swing-out angle less than 77 degrees, the runaway boom phenomenon occurs. A feature of this invention is that this runaway boom phenomenon can be prevented through the use of auxiliary derricks as described hereinafter.

Figure 17:
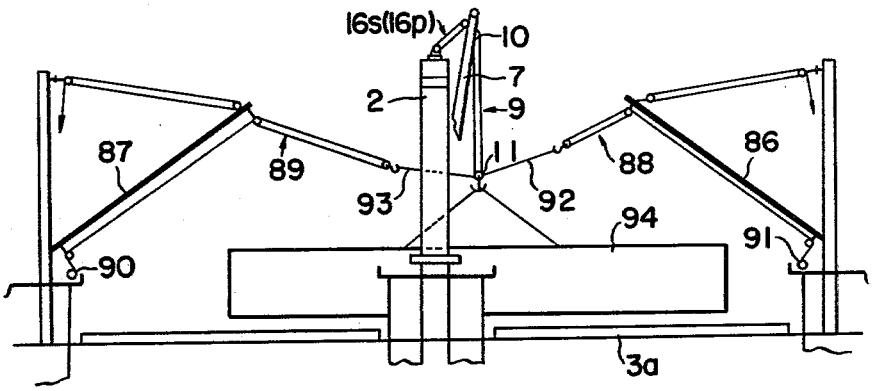
FIGS. 17 and 18 are respectively a side elevation and a plan view diagrammatically indicating the manner in which a double-topping type cargo-handling machine according to this invention is used to handle a long cargo unit.
Figure 18:
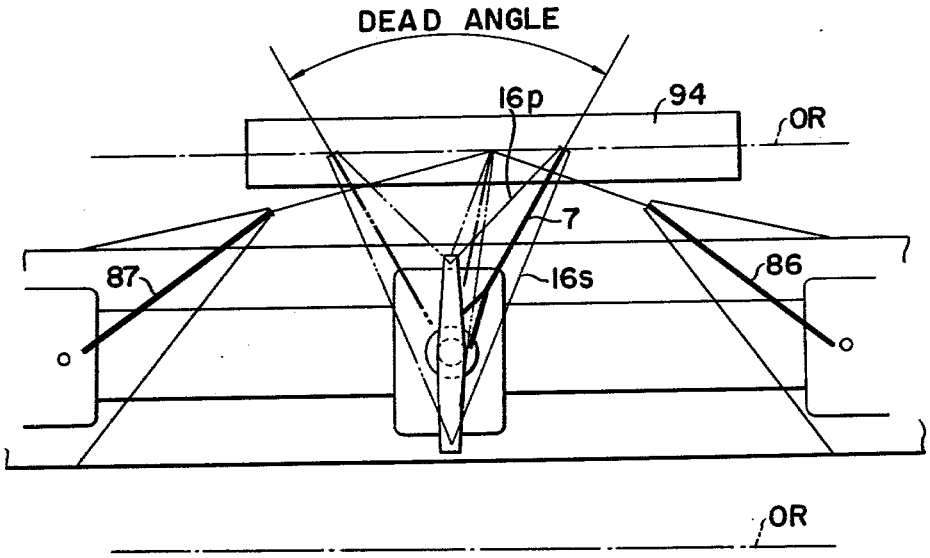

Another feature of this invention is that the cargo-handling machine can be switched in a very short time of a few minutes from operation with respect to one hatch (e.g., the forward hatch) to that with respect to the other hatch (the after hatch) by swinging the boom around the ship side. Referring to FIGS. 17 and 18, as the cargo position is shifted from the position of a boom swing-out angle of 60 degrees and along the out reach line OR (i.e., cargo swing-out limiting line) to the position corresponding to a boom swing-out angle of 90 degrees, the boom topping angle is changed from 45 degrees to 52.24 degrees, and the stress load on the topping tackles decreases, whereby there is no problem relating to the strength of the machine. The force which contributes to a runaway boom is a mere 3.5 tons due to the trim angle as mentioned hereinabove, and this force also is a maximum when the boom swing-out angle is in the vicinity of 90 degrees.

Ordinarily, a heavy cargo ship is equipped with common derricks of capacities of the order of 10 tons as auxiliary derricks for the heavy cargo-handling machinery. According to this invention, these common derricks are utilized to increase remarkably the cargo-handling capacity of the main cargo-handling machine as described hereinbefore with reference to and as illustrated by FIG. 14. One example of the manner in which this is accomplished according to this invention in handling long cargo units is illustrated in FIGS. 17 and 18. On the forward and after sides of the main derrick, at the far opposite sides of the loading area, common derricks with booms 86 and 87, cargo hoisting tackles 88 and 89, winches 91 and 90, and pendants 92 and 93 joining the outer ends of the tackles 88 and 89 and the outer block 11 of the cargo hoisting tackle of the main derrick are provided. The main derrick is being operated to load a long cargo unit 94. In this example, the pendants 92 and 93 are made of wire rope and, in the case where the block 11 of the main derrick is used on board, are connected to the outer blocks for cargo hoisting of the common derricks.

By operating the topping tackles **16*s* and 16*p*, the main derrick boom 7 is moved to a cargo hoisting position above the out reach line OR appropriate for the length of the hoisted cargo, and the tackles 88 and 89 of the common derricks are caused to follow accordingly. When the cargo unit has been hoisted to a specific position, the above mentioned force of 3.5 tons due to the trim angle is caused to be borne by the tackle 88 by the operation of the topping tackles 16*s* and 16*p***, and, in this condition, the cargo unit is moved out of the dead-angle zone and thereafter loaded onto the loading deck.

During cargo handling in the dead-angle zone, when the main derrick boom 7 is in the vicinity of 90 degrees relative to the ship centerline, the derrick is in a state of topping on only one side by the topping tackle **16*s*. However, since the topping angle of the boom 7 is large as mentioned hereinbefore, the topping stress load thereon is small, and there is no particular necessity to increase the strength thereof. Furthermore, even under the state of one-sided topping, forces act normally on the pin 48 shown in FIGS. 6 and 7, similarly as in the case of stress forces acting as a result of the combined forces of the topping tackles 16*s* and 16*p*, whereby no variation due to one-sided topping occurs in the main boom 7**.

In the case where, in cargo handling in the dead-angle zone, a relatively large number of long cargo units are being loaded on the after deck for convenience in navigation, the cargo hoisting tackle 88 functions as a brake with respect to the stress load of a maximum of 3.5 tons, while the hoisting tackle 89 follows the hoisting block 11 as a preparedness measure for emergencies caused by oscillations of the hoisted cargo due to waves.

As will be apparent from the foregoing description, a feature of the cargo-handling machine of double-topping type of this invention is that it is capable of effectively loading and unloading cargo into and out of two hatches or loading deck areas positioned fore and aft thereof without the necessity of removing and refitting the boom topping tackles. Another feature of this machine is that it is capable of operating through a total boom swing or azimuth angle of 300 degrees including the zone ordinarily considered to be a dead-angle zone on one side of the ship. A corollary feature of this machine is that it can load long cargo units in an efficient manner without mutual interference therebetween.

What is claimed is:

1. A cargo-handling machine for shipboard use comprising: a derrick post fixedly and uprightly mounted on a structural part of a ship between two loading areas forward and aft of the post; an outrigger fixed to the top of the derrick post and having two arms extending laterally outward from the post; a derrick boom pivotally supported at its inner end by a gooseneck connection positioned substantially below the middle point of the outrigger equidistant from the two outer ends thereof and permitting topping movement of the boom and azimuthal turning thereof continuously through at least 150 degrees of angle clockwise and counterclockwise from a dead-abeam position relative to the outrigger; a cargo-hoisting tackle suspended at its upper end from the top end of the boom; a hoisting winch for operating the cargo-hoisting tackle; two boom-topping tackles connected at their inner ends to respective swivel pulleys pivotally secured respectively to the two outer ends of the outrigger; topping winches for respectively operating the topping tackles; and a multiple-swivel universal coupling connected between the top end of the boom and the outer ends of the two topping tackles and functioning to permit the two topping tackles to undergo inversion of their positions relative to the boom without mutual contacting or entwinement when the boom turns azimuthally through said dead-abeam position from one loading area to the other.

2. A cargo-handling machine as claimed in claim 1 in which the topping tackles have respective outer swivel blocks at their outer ends, and the universal coupling comprises a pivotable member pivotally connected by a horizontal pin to the top of the boom and a swivel comprising two swivel members rotatably joined together for swiveling rotation relative to each other, one of the swivel members being pivotally connected by a vertical pin to the pivotable member, the other swivel member being pivotally connected by two pins respectively to the swivel parts of the outer swivel blocks of the topping tackles.

3. A cargo-handling machine as claimed in claim 2 in which said one of the swivel members is a swivel socket member, and said other swivel member is a headed-stem member having a head rotatably enclosed within the swivel socket member and having an external yoke part with two spaced-apart ends, to which the swivel parts of the outer swivel blocks of the topping tackles are connected.

4. A cargo-handling machine as claimed in claim 2 in which said one of the swivel members is a headed-stem member having a head and a stem part and pivotally connected at the end of its stem part by a vertical pin to the pivotable member, and said other swivel member is a swivel socket member having a socket, within which said head is rotatably enclosed, and having a yoke part with two spaced-apart ends, to which the swivel parts of the outer swivel blocks of the topping tackles are connected.

5. A cargo-handling machine as claimed in claim 1 or 2 in which the derrick post is mounted at a position offset laterally from the ship centerline, the arms of the outrigger being of unequal length, the longer of the arms extending over the gooseneck connection, which is disposed substantially on the ship centerline at a position spaced apart from the derrick post.

6. A cargo-handling machine as claimed in claim 1 or 2 in which the arms of the outrigger are of equal length, and the gooseneck connection comprises a gooseneck ring having a turnable ring disposed around the derrick post at a lower part thereof and a forked inner end of the boom pivotally connected to the turnable ring in a manner permitting said topping movement.

7. A cargo-handling machine as claimed in claim 1 or 2 in which: the arms of the outrigger are of equal length; the gooseneck connection comprises a gooseneck ring having a turnable ring disposed around the derrick post at a lower part thereof and a forked inner end of the boom pivotally connected to the turnable ring in a manner permitting said topping movement; and the hoisting and topping winches are installed at a low position in the ship.

8. A cargo-handling machine as claimed in claim 1 or 2 which is operated in combination with auxiliary derrick cranes respectively disposed on the far sides opposite from said machine of the loading areas forward and aft thereof and having respective hoisting tackles connected via respective pendants to the lower end of the cargo-hoisting tackle of the machine, the auxiliary derrick cranes being operated to assure stable operation of the derrick boom of the machine and to prevent occurrence of a runaway boom phenomenon.

* * * * *